United States Patent [19]

Egigian

[11] 4,272,575

[45] Jun. 9, 1981

[54] ANCHOR MAT

[76] Inventor: Robert S. Egigian, c/o Mrs. Evelyn Kuntz, 2700 Zinfandel Dr., Rancho Cordova, Calif. 95670

[21] Appl. No.: 108,213

[22] Filed: Dec. 28, 1979

[51] Int. Cl.[3] ..... B32B 3/02; B32B 3/04

[52] U.S. Cl. ..... 428/83; 5/417; 52/4; 135/15 PE; 428/192; 428/102

[58] Field of Search ..... 5/417; 428/33, 83, 192, 428/102; 52/3, 4, 23, 169.14; 135/15 PE

[56] References Cited

U.S. PATENT DOCUMENTS

| | | | |
|---|---|---|---|
| 3,237,904 | 3/1966 | Abruzese | 5/417 X |
| 3,862,876 | 1/1975 | Graves | 428/83 |

*Primary Examiner*—Henry F. Epstein

[57] ABSTRACT

A mat for use upon a beach, the mat including an anchor at each opposite end thereof, so as to prevent a strong wind from blowing it away, while persons are not lying down thereupon, such anchor consisting of a scoop that digs under the sand, so as to be anchored therebeneath.

1 Claim, 6 Drawing Figures

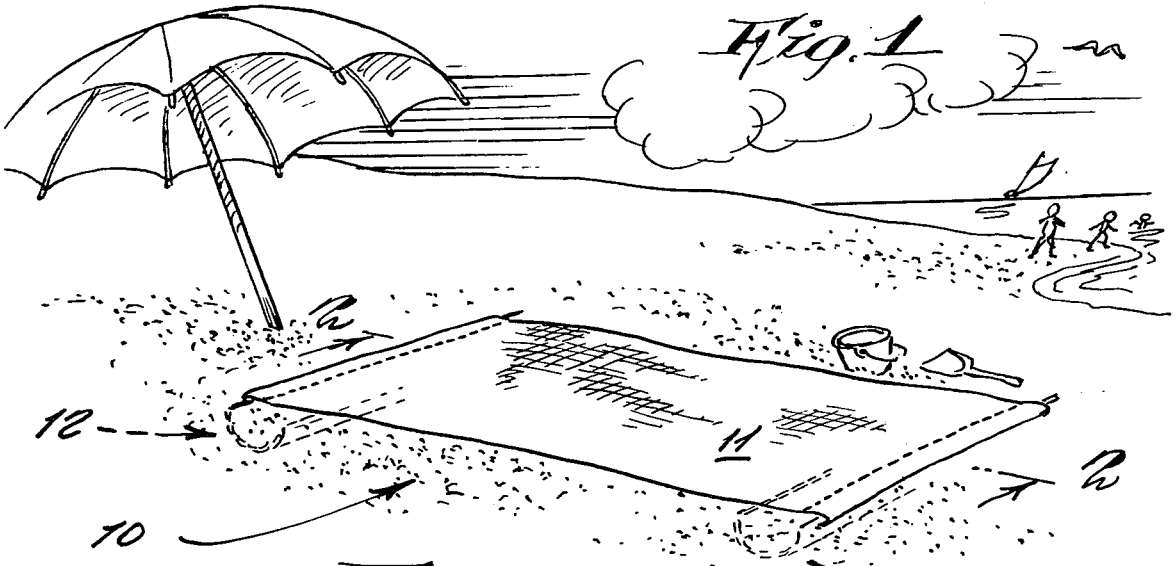
Fig. 1
12
11
10
12
12
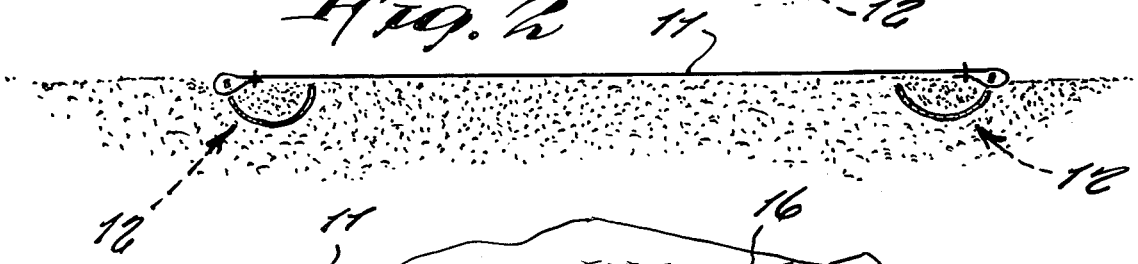
Fig. 2
14
12
12
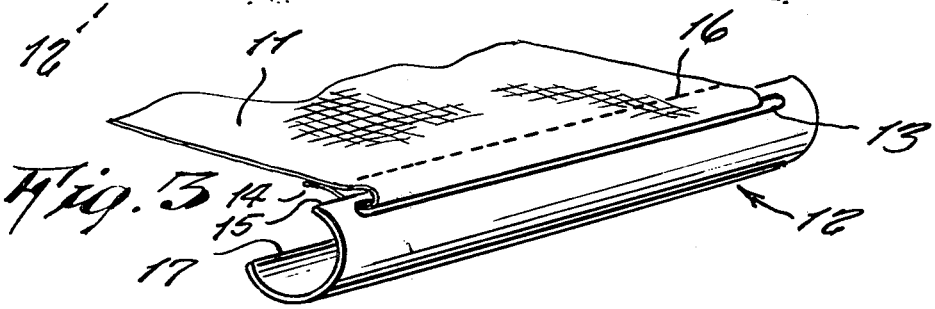
11
16
13
Fig. 3
14
15
17
12
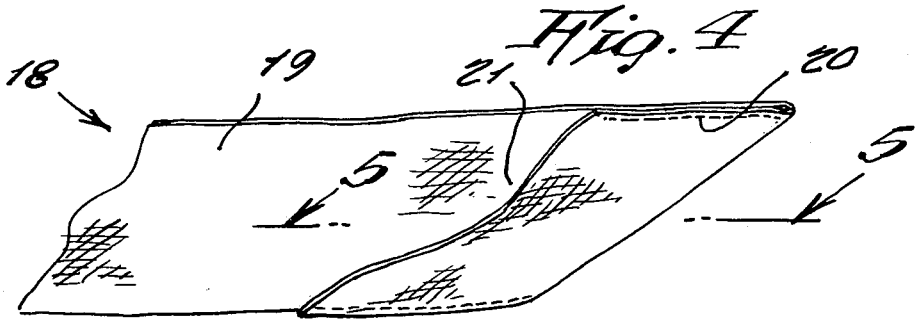
Fig. 4
18
19
21
20
5
5
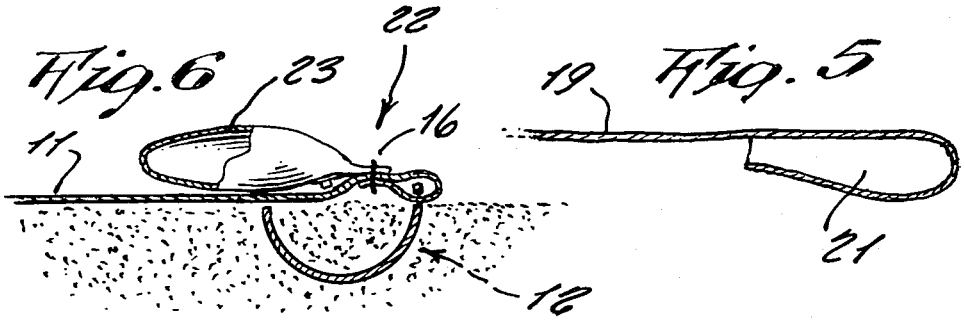
Fig. 6
23
22
16
11
12
Fig. 5
19
21

ANCHOR MAT

This invention relates generally to beach accessories, for use by swimmers and sun-bathers. More specifically, it relates to beach mats.

It is well known, that when a conventional beach mat or large beach towel is spread out upon the sand, so that persons may lie down thereupon, it is subject to be blown away easily in the usually stronger sea-shore winds, while the persons are away swimming in the water. Accordingly, it is a practice to place heavy objects, such as a lunch basket, bundles of clothing, and the like at the corners, so as to hold the mat down in the wind. Even while persons rest thereupon, a wind may lift a free end of the mat, and blow it on a person, together with any sand that is on it. This situation is, accordingly, in need of an improvement.

Therefore, it is a principal object of the present invention to provide an anchor mat, wherein a beach mat includes an anchor means at each opposite end, for quickly and easily anchoring it in the sand, so that a wind cannot lift it, and blow it away.

Another object is to provide an anchor mat, which can be folded up into a small bundle, similarly to a beach towel or conventional beach mat, so as to be conveniently carried to and from a beach.

Other objects are to provide an anchor mat, which is simple in design, inexpensive to manufacture, rugged in construction, easy to use, and efficient in operation.

These, and other objects, will be readily evident, upon a study of the following specification, and the accompanying drawing wherein:

FIG. 1 is a perspective view of the invention, shown installed in the sand of a beach;

FIG. 2 is a side cross-sectional view, on line 2-2 of FIG. 1;

FIG. 3 is a perspective view of one end of the beach mat, showing an anchor mat secured thereto;

FIG. 4 is a bottom perspective view, showing another design of the invention in which a pocket is simply sewn under each end of the beach mat, for being filled with sand; and which thus uses no stiff components, so that it can be folded up small, when carried to the beach or stored away;

FIG. 5 is a cross-sectional view, on line 5—5 of FIG. 4, showing a typical fabric pocket, and FIG. 6 is another cross-sectional view, similar to one end shown in FIG. 2, and wherein an air-inflated pillow is attached to each end of the beach mat, so as to prevent feeling the stiff edge of the anchor mat underneath.

Referring now to the drawing in greater detail, and more particularly to FIGS. 1, 2 and 3 thereof at this time, the reference numeral 10 represents an anchor mat, according to the present invention, wherein there is a rectangular mat 11, woven from conventional fabrics in any color or design. At each opposite longitudinal end thereof, an anchor 12 is attached. The anchor is a generally semicylindrical shaped channel, formed from a rigid sheet plastic material. A suggested size thereof is to be thirtysix inches long. A distance across the mouth of the scoop is three inches wide, and the depth of the channel is approximately two and one-half inches. An elongated slot 13, near one longitudinal edge 14, serves for an entire end edge 15 of the mat to be fitted therein, and then being sewn, with a stitch 16, to the underside of the mat, thus permanently securing the two together. The anchor may be made in any attractive color, and when the anchor mat is folded up for carrying or storing, one anchor will readily fit inside the other due to a slight flexibility of the plastic material thereof.

In use, the anchor is used as a scoop, by the opposite longitudinal edge 17 serving as a scoop lip in digging down into the sand, and then rolling the anchor in order that the sand rests inside the channel thereof, and the weight of the sand holds the anchor down. The anchor is thus rolled under the end of the mat, as shown in FIG. 2, so as not to protrude therefrom, where persons walking by might step on its edge 17. When both opposite anchors are thus installed at the beach, the mat cannot blow away in a wind.

Referring now to FIGS. 4 and 5, another design of anchor mat 18 is shown, that includes a rectangular mat 19, made of fabric, raffia or the like, and which, at opposite ends, is turned over, and sewn with stitches 20 along each side edge, so as to form a pocket 21, into which sand can be shovelled, so as to form an anchor. In this design, no rigid plastic component is used, so that the anchor mat can thus fold more compactly when stored away.

Referring now to FIG. 6, still another design of anchor mat 22 is shown, and which comprises the above-described anchor mat 10, together with an inflatable plastic pillow 23. Such pillow is attached to each end of the mat, as shown, so that it rests above the anchor, and, when inflated, protects a person's head from resting upon the hard anchor edge 17, if not sufficiently covered over in the sand.

While various changes may be made in the detail construction, it is understood that such changes will be within the spirit and scope of the present invention, as is defined by the appended claims.

What I now claim is:

1. An anchor mat, comprising, in combination, a rectangular mat and an anchor secured at each opposite end thereof, said mat being made of any woven material, and each said anchor including means for using the weight of beach sand for anchoring said mat opposite ends; said means comprising a scoop for being inserted into said sand; said scoop being a generally semi-cylindrical shaped channel, formed from a rigid sheet of plastic material, an elongated slot near one longitudinal edge thereof, one end edge of said mat being fitted therein and sewn into a loop around said longitudinal edge of said scoop, and a pillow on top said mat cushioning an opposite longitudinal edge of said scoop when under said mat.

* * * * *